US005193670A

United States Patent [19]

Fong

[11] Patent Number: 5,193,670

[45] Date of Patent: Mar. 16, 1993

[54] LAUNDRY DETERGENT AND COIN DISPENSER

[76] Inventor: Mary W. G. Fong, 333 Aoloa St. #232, Kailua, Hi. 96734

[21] Appl. No.: 802,827

[22] Filed: Dec. 6, 1991

[51] Int. Cl.[5] ..... A45C 1/00; B67D 5/00

[52] U.S. Cl. ..... 206/0.81; 206/216; 206/229; 222/129; 222/192

[58] Field of Search ..... 206/0.8, 0.81, 216, 206/223, 229; 222/132, 129, 192, 130

[56] References Cited

U.S. PATENT DOCUMENTS

| | | | |
|---|---|---|---|
| 225,993 | 3/1880 | Meaker | 206/0.81 X |
| 339,420 | 4/1886 | Hubbard et al. | 206/0.81 X |
| 853,300 | 5/1907 | Erickson | 206/229 |
| 1,171,185 | 2/1916 | Fox | 206/0.81 X |
| 1,179,007 | 4/1916 | Hoover | 206/0.81 X |
| 2,041,170 | 5/1936 | Dorsey | 206/0.8 |
| 2,130,502 | 9/1938 | Lindemann | 206/0.81 X |
| 2,429,661 | 10/1947 | Amsterdam | 206/0.81 X |
| 2,996,177 | 8/1961 | Sproull et al. | 206/0.81 |
| 3,262,478 | 7/1966 | Amsterdam | 206/0.81 X |
| 3,842,976 | 10/1974 | Dea | 206/223 X |
| 4,598,339 | 10/1985 | Gorman | 222/129 |

FOREIGN PATENT DOCUMENTS

| | | | |
|---|---|---|---|
| 186292 | 5/1907 | Fed. Rep. of Germany | 206/0.81 |

*Primary Examiner*—Bryon P. Gehman
*Attorney, Agent, or Firm*—John P. Halvonik

[57] ABSTRACT

The invention is a small, lightweight, container to hold both laundry detergent and coins. The two primary compartments are for storing liquid cleaning products and have reclosable lids with pouring spouts. The two compartments allow two different substances to be held and poured separate with a separate compartment that holds coins and a small uncovered space to hold miscellaneous items.

2 Claims, 1 Drawing Sheet

LAUNDRY DETERGENT AND COIN DISPENSER

BACKGROUND OF THE INVENTION

1. Field of the Invention

The invention relates to the field of laundering accessories and, in particular, to a small container for holding both laundry detergent and coins.

2. Prior Art

While there are small units for holding coins, none that applicant is aware of can be used to hold both laundry detergent and coins.

SUMMARY OF THE INVENTION

The apparatus of the present application is a combination coin holder and laundry detergent dispenser that comprises one small lightweight container with four compartments. The two larger compartments have individual lids with capped openings for pouring, allowing two different substances to be contained and poured separately. There is one small compartment to hold coins and another small compartment for miscellaneous items such as keys.

It is the object of this invention to provide a small lightweight compartment that can hold both coins and laundry detergent when one goes to a laundromat.

Other advantages of the invention will become apparent once the invention is shown and described.

DESCRIPTION OF THE PREFERRED EMBODIMENT

Figure 1:
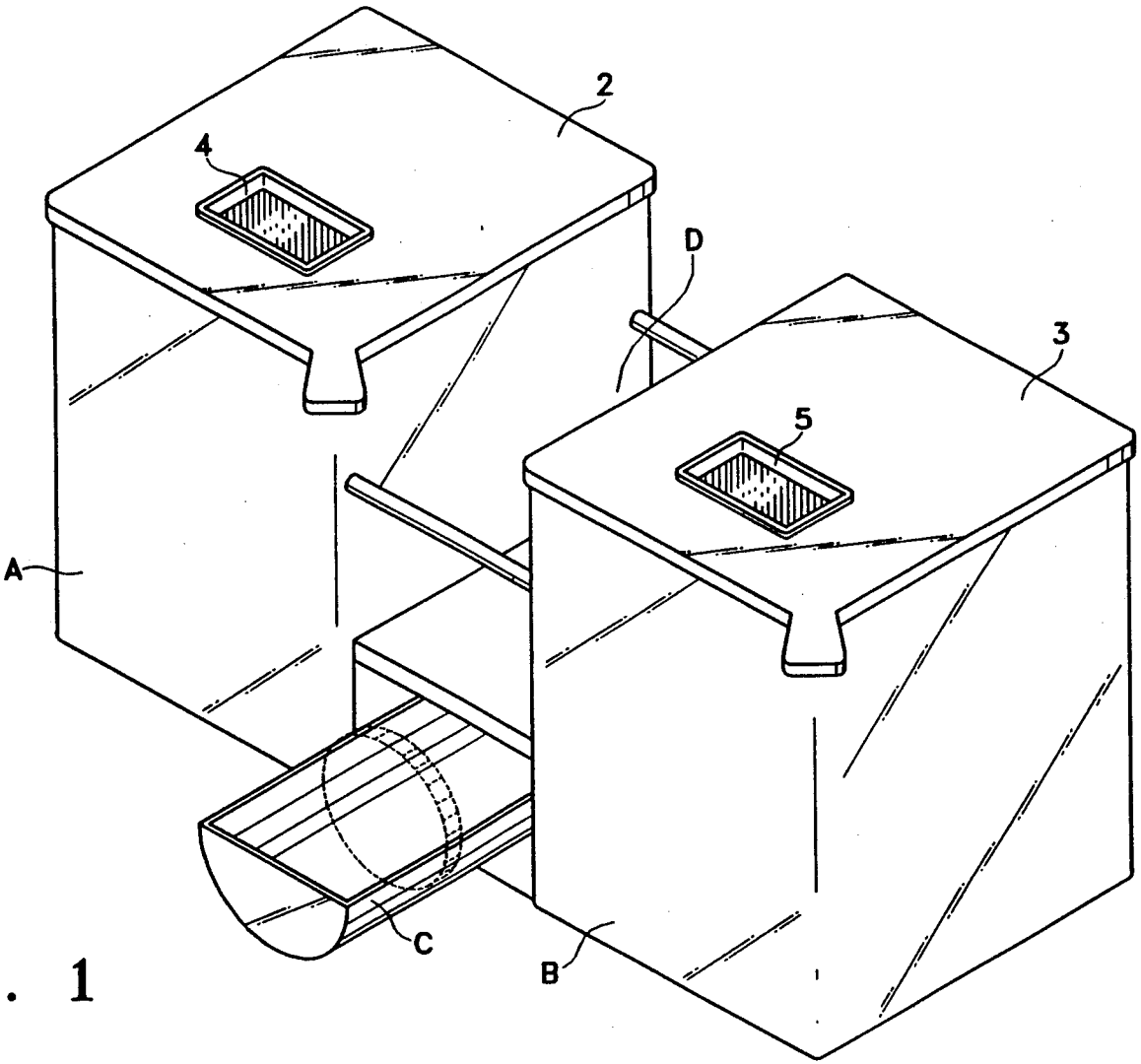
FIG. 1 shows the overall construction of the device with pull out coin drawer.

The invention comprises a small light weight container divided into four compartments: two detergent compartments, 10 and 11; one coin drawer, 12; and one small uncovered space 13 for holding miscellaneous items. The detergent compartments are covered by two snap on lids, 2 and 3 for refilling the compartments and two spout covers 4 and 5 over the openings (spouts) in the lids that are used for pouring when one is in the laundromat. There are, preferably, calibrations on the sides of the compartments for measuring the volume of detergent to be used.

There is a slide out drawer to hold coins in space 13. The drawer may be uncovered. The drawer would preferably have a curved tray for holding the coins and may be divided into a plurality of sections by partitions. Part 13 is a small uncovered space that may be used to hold miscellaneous items such as keys. The two largest compartments are the detergent holders 4 and 5 which are essentially two square containers separated by space 13. The compartments are joined to each other by the walls of the small space 13. A flexible carrying strap may optionally be attached to the outer walls of 10 and 11.

The small space 13 is used to hold miscellaneous items that need to be stored by the user while he/she does the wash. Typically, this would be a set of keys or folded fabric softener sheets.

The shape and size of the compartments could vary with a smaller version using only one detergent section also possible. Alternate materials could be used in the construction of the compartments. Any material that is liquid proof and relatively rigid could be used in the construction. Similar materials could be used for the coin holders and the small space 13.

Spouts on the sides of the detergent sections could replace the capped openings on the lids. A carrying strap or handle may be added to the container. Substances other than or in addition to detergent could be contained and dispensed as well.

I claim:

1. Container for holding laundry supplies comprising: left and right liquid-holding compartments, said compartments having reclosable lid portions for permitting the refilling of said compartments, said lid portions each having a pouring spout, a connecting portion in connection with each of said compartments to hold said compartments at a distance from one another to define a space located between said compartments, and means for holding coins in an upright position, said means comprising a slide-out drawer engaged with each of the compartments and located within said space.

2. The apparatus of claim 1 wherein said compartments have bottom wall portions and side wall portions so as to form a rectangular enclosing portion for holding liquid laundry supplies.

* * * * *

UNITED STATES PATENT AND TRADEMARK OFFICE

CERTIFICATE OF CORRECTION

PATENT NO. : 5,193,670

DATED : March 16, 1993

INVENTOR(S) : Mary W.G. Fong

It is certified that error appears in the above-indentified patent and that said Letters Patent is hereby corrected as shown below:

On col. 1, line 41: "10" should be --A-- and "11" should be --B--; col. 1 line 41: "12" should be --C--; col. 1. line 42: "13" should be --D--;

On col. 2. line 3: "13" should be --D--; col. 2. line 7: "13" should be --D--; col. 2, line 9 "4" should be --A-- and "5" should be --B--; col. 2. line 11: "13" should be --D--; col. 2. line 12: "13" should be --D--; col. 2, line 13: "10" should be --A-- and col. 2 line 14: "11" should be --B--; col. 2. line 15: "13" should be --D--; col. 2. line 25: "13" should be --D--.

Signed and Sealed this

Thirteenth Day of September, 1994

*Attest:*

Bruce Lehman

BRUCE LEHMAN

*Attesting Officer*

*Commissioner of Patents and Trademarks*